US005172612A

United States Patent [19]

Hansson

[11] Patent Number: 5,172,612

[45] Date of Patent: Dec. 22, 1992

[54] SOCKET HOLDER

[75] Inventor: Gunnar C. Hansson, Stockholm, Sweden

[73] Assignee: Atlas Copco Tools AB, Sweden

[21] Appl. No.: 677,418

[22] Filed: Mar. 29, 1991

[30] Foreign Application Priority Data

Apr. 11, 1990 [SE] Sweden ..... 9001328-5

[51] Int. Cl.[5] ..... B25D 21/00

[52] U.S. Cl. ..... 81/57.13; 81/177.85; 285/317

[58] Field of Search ..... 81/54, 57, 57.13, 57.29, 81/177.85; 285/317; 403/328

[56] References Cited

U.S. PATENT DOCUMENTS 3,796,502 3/1974 Federspiel ..... 285/317 X
4,627,761 12/1986 Olson et al. ..... 81/177.85 X
5,090,747 2/1992 Kotake ..... 285/317 X

*Primary Examiner*—James G. Smith

*Attorney, Agent, or Firm*—Watson, Cole, Grindle & Watson

[57] ABSTRACT

When using hand-held electrically or pneumatically driven tools, for instance angled nut tighteners, different socket wrenches or box spanners (6) are used for different work processes. In order to enable a socket to be fitted quickly to a tool, the tool is provided with a manouverable socket holder (9), which also enables the socket to be readily removed from the tool. The socket holder includes a radially movable device (10) which is connected to the tool and which can be moved to positions in which it is excentric with or concentrical with the output shaft of the tool. A spring means (13) is provided for activation of the locking device to its excentric position relative to the output shaft, such as to hold a socket firmly thereto. The locking device (9) includes an inner, hook-shaped ring flange (12) whose internal diameter is greater than the diameter of an outer hooked flange (16) on the socket (6), therewith enabling the socket (6) to be released when the locking device (9) is positioned concentrically.

8 Claims, 2 Drawing Sheets

SOCKET HOLDER

TECHNICAL FIELD

The present invention relates to a socket-holder for a tool which together with said socket-holder, can be detachably connected to various sockets intended for different working procedures, preferably for tightening screw or nut joints.

BACKGROUND ART

When using hand-held, electrically or pneumatically driven tools different sockets, or sleeves, can be attached to the driving, output shaft of the tool so that the tool is able to perform different kinds of work. In order to enable a socket to be fitted quickly to the output shaft of the tool, the tool shaft has been given a substantially square cross-sectional shape, such as the form of a square peg, and the socket has been provided with a corresponding square hole. In order to enable the socket to be connected detachably to the tool shaft, the shaft has been provided with one or more spring-operated locking balls which are pressed into holes in the shaft when the socket is pressed onto the shaft. The balls then fixate the socket, by being pressed-out, under the action of a spring force, into grooves or the like provided in the socket, when the socket is positioned correctly on the shaft. The socket can be fitted to and removed from the hand-held tool manually. The socket is first aligned with the tool shaft and then pressed onto the shaft. Subsequent to using the socket, or when wishing to replace the socket with another, the socket is pulled sharply and forcibly away from the shaft.

DISCLOSURE OF THE INVENTION

In order to enable a socket to be fitted readily to a tool provided with a driving output shaft and to enable the socket to be held in position on said shaft, the tool is provided with a socket holder which can be adjusted between a locked position and a released position. When using a tool to which a socket is fitted with the aid of a socket holder, the tool with the socket holder fitted thereto is moved towards a free socket and the socket-receiving opening in the socket holder is moved radially relative to the tool output shaft, so that the socket-engagement opening on the socket holder can be fitted to the engagement region on the socket. The tool fitted with the socket holder is lowered further over the socket, wherewith the tool shaft will extend into a corresponding hole in the socket. When the socket is positioned correctly on the shaft, a spring in the socket holder displaces the same relative to the socket so as to hold the socket firmly. The socket is released from the output shaft by slightly displacing the socket holder, for instance by bringing the tool with the socket holder fitted thereto against an abutment means, so as to position the socket-holder opening concentrically with the engagement region on the socket. The socket can now be removed from the tool shaft. The socket holder movably connected to the tool has an inwardly extending flange which fits into a corresponding groove or the like provided on the socket, such as to hold the socket firmly fitted to the tool shaft when the tool is in use.

DESCRIPTION OF A PREFERRED EMBODIMENT

Figure 4:
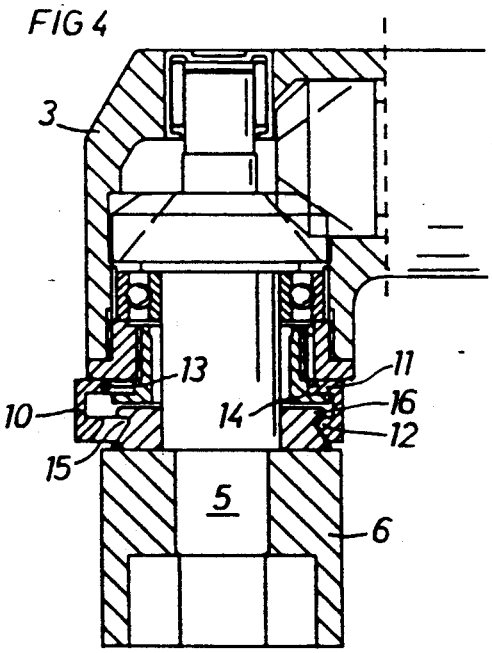
FIG. 4 is a cross-sectional view of the angled head of the tool illustrated in FIG. 1, with a socket attached firmly to said head.
Figure 5:
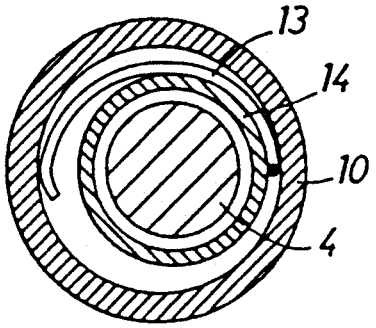
FIG. 5 is a cross-sectional view of a socket holder according to FIG. 4.
Figure 6:
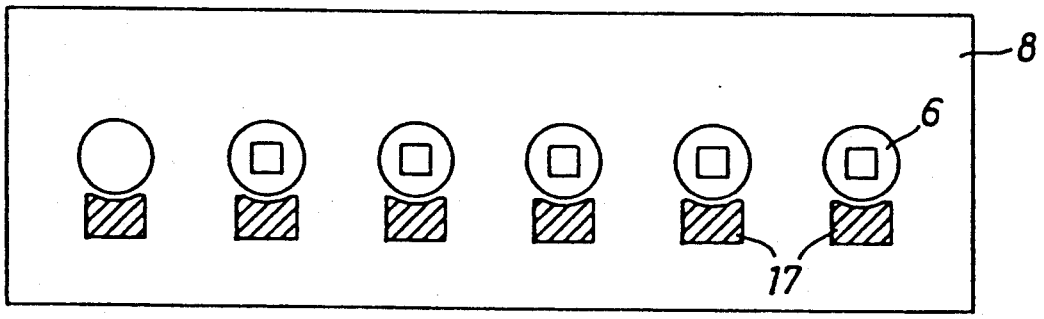
FIG. 6 illustrates a rack which holds a number of sockets according to FIG. 3 with associated abutments means.

The Figures of the accompanying drawing illustrate the construction of an electrically or pneumatically driven hand-held angled nut-tightener fitted with a socket holder in accordance with the invention. The nut tightener 1 has a drive part which is housed in a holder part 2 connected to an angled head 3 which is provided with a tool shaft 4. The output end of the shaft 4 is configured as a square peg 5, in order to enable the shaft to be fitted to different sockets or sleeves 6, for instance different socket wrenches or box spanners. The various sockets 6 are intended for use with the angled nut tightener and have a correspondingly configured square hole 7. Several socket wrenches 6, of mutually different dimensions are placed in a row on a socket rack 8 in a fitting station located in the proximity of the nut tightener. In order to enable a socket 6 to be fitted to and removed from the nut tightener 1 in a ready and simple fashion, the angled head 3 is provided with a movable, but not co-rotational, socket holder 9, which includes a radially displaceable and spring-activated locking ring or annulus 10 having inwardly extending, top and bottom hook-shaped ring flanges 11, 12. The spring action is obtained by means of a wire spring 13 which is inserted between the locking ring 10 of the socket holder and a flange-like outer end 14 of the head 3. The wire spring is arranged so that the spring force exerted thereby will act on the locking ring 10 and displace said ring to an eccentric locking position, see FIG. 4. The bottom, inwardly extending hook-shaped ring flange 12 on the locking ring 10 of the socket holder is configured to fit into a corresponding groove 15 with hook flange 16 on the socket 6, so as to hold the socket against axial movement when fitting the socket onto the square peg or shaft 5 in the eccentric locking position.

Figure 3:
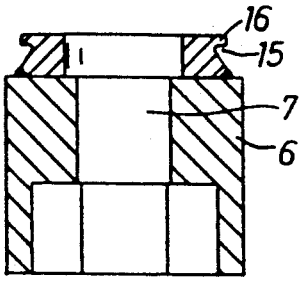
FIG. 3 illustrates a socket or sleeve configured for detachable attachment by means of the tool illustrated in FIGS. 1 and 2.

A socket 6 is fitted to the nut tightener by moving the angled head 3 against the socket 6 with an axially directed force, whereupon the hook-shaped ring flange 12 of the locking device 9 will be displaced radially against a spring force and snap into the socket 6, past a corresponding ring flange 16, see FIG. 3.

Figure 1:
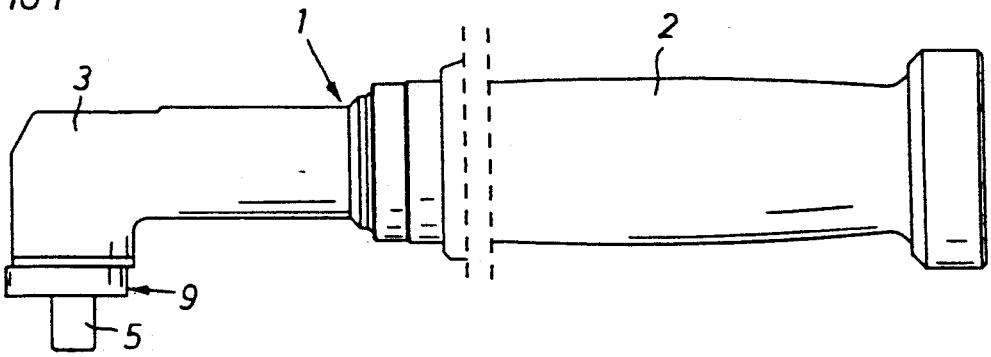
FIG. 1 illustrates a rotatable inventive hand tool provided with an angled head and tool shaft.
Figure 2:
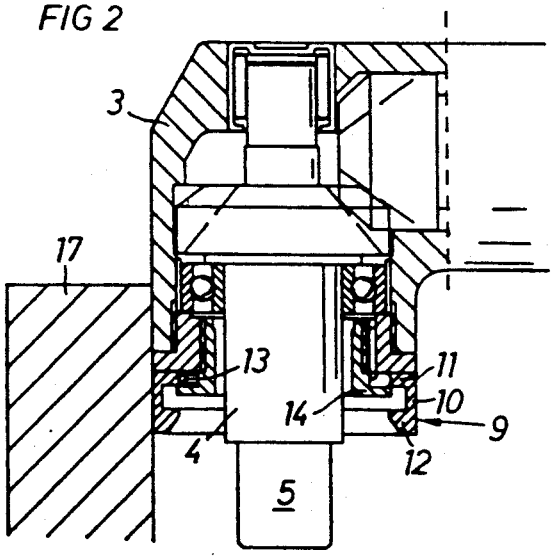
FIG. 2 is a cross-sectional view of the angled head of the tool illustrated in FIG. 1 with a socket holder moved against an abutment surface.

When removing a socket 6 from the tool, it is necessary first to move the locking ring 10 to its concentric open position, against a spring force, see FIG. 2. Since the internal diameter of the ring flange 12 on the locking ring 10 is greater than the diameter of the hook-shaped flange 16 on the socket 6, the socket 6 is free to leave the square peg 5 of the nut tightener when this concentric and open position is realized. The coupling release movement of the locking ring 10 is achieved through mutual coaction between the locking ring 10 and an appropriate abutment means 17. For instance, an abutment 17 in the form of a vertical post or pillar, may be positioned immediately adjacent each rack of sockets at the fitting station 8. The socket 6 can be loosened from the socket holder 9, by pressing the locking ring 10 on the socket holder 9 of the nut tightener against the abutment means 17, such as to cause the locking ring to move to its concentric position.

This type of socket holder can be used with automatized fitting work, for instance work performed by robots, in addition to its use with hand-held tools. When the socket holder is used with robots that are provided with position sensors, the empty tool can be moved forwards to an appropriate socket in accordance with a given program and pressed onto the socket and held thereto with the aid of the sprung locking ring. Upon completion of a working step, the tool is returned to the place from which the socket was collected. The locking ring on the tool is then moved against an abutment, or an abutment is then moved against the locking ring, wherein the locking ring is moved radially to a position concentrical with the shaft journal and the socket can be removed.

I claim:

1. A socket holder for detachably holding a socket on the tool output shaft of an electrically or pneumatically operated power wrench having a housing, wherein a locking device which is movably but non-rotatably connected to the power wrench housing is adjustable from a socket locking position to a socket release position against the action of a spring means, and in said locking position the locking device engages a groove on a socket so as to positively lock said socket against axial displacement.

2. A socket holder according to claim 1, wherein the locking device is ring-shaped and is intended to be moved to a position in which it is eccentrical in relation to the tool output shaft so as to firmly hold a socket, and to be moved to a position in which it is located concentrically in relation to said output shaft, so as to enable a socket to be fitted to or removed from said socket holder.

3. A socket holder according to claim 1, wherein the spring means is intended to act between the locking device and the tool, said spring means being ring-shaped.

4. A socket holder according to claim 1, wherein the locking device is intended to be deactivated by an external device for displacing and removing the socket.

5. A socket holder according to claim 4, wherein said external device is an abutment means provided at each socket location in a row of sockets on a socket rack.

6. A socket holder according to claim 1, wherein the locking device is a locking ring.

7. A socket holder according to claim 6, wherein the internal diameter of the locking ring is greater than the external diameter of the corresponding engagement part of the socket.

8. A socket holder according to claim 6, wherein the locking ring is provided with a flange component which is ring-shaped and which engages the groove on the socket.

* * * * *